United States Patent [19]

Wassell et al.

[11] Patent Number: 4,482,296

[45] Date of Patent: Nov. 13, 1984

[54] BLADED ROTOR ASSEMBLY AND METHOD OF FORMING SAME

[75] Inventors: Mark E. Wassell, Bloomfield; John G. Mosimann, Ellington, both of Conn.

[73] Assignee: Terry Corporation, Windsor, Conn.

[21] Appl. No.: 408,228

[22] Filed: Aug. 16, 1982

Related U.S. Application Data

[63] Continuation-in-part of Ser. No. 321,338, Nov. 16, 1981.

[51] Int. Cl.[3] ..... F01D 5/22; F01D 5/32

[52] U.S. Cl. ..... 416/215; 416/216; 416/218; 416/220 R; 416/500

[58] Field of Search ..... 416/215, 216, 218, 500, 416/220 R

[56] References Cited

U.S. PATENT DOCUMENTS

| | | | |
|---|---|---|---|
| 2,281,318 | 4/1942 | Neufeld | 416/215 |
| 2,874,932 | 2/1959 | Sörensen | 416/220 |
| 2,997,274 | 8/1961 | Hanson | 416/500 |
| 3,076,633 | 2/1963 | Bridle et al. | 416/216 |
| 3,279,751 | 10/1966 | Ortolano | 416/220 |
| 3,367,629 | 2/1968 | Partington | 416/500 |
| 3,393,862 | 7/1968 | Harrison | 416/220 |
| 4,255,086 | 3/1981 | Roberts | 416/218 |

FOREIGN PATENT DOCUMENTS

| | | | |
|---|---|---|---|
| 412343 | 4/1925 | Fed. Rep. of Germany | 416/215 |
| 322010 | 7/1957 | Switzerland | 416/215 |

*Primary Examiner*—Stephen Marcus
*Assistant Examiner*—John Kwon
*Attorney, Agent, or Firm*—B. J. Murphy

[57] ABSTRACT

The Assembly has a submerged root, turbine-wheel-blading configuration, and utilizes circumferentially oriented, buried, friction damping wires, and continuous, overlapping, tip shrouds to minimize vibratory response. The wires, in the presence of blade vibration, simultaneously rub on both the blades and surfaces of a recess in the wheel in which the blade roots are fixed. The continuous tip shrouding provides additional damping through shroud-to-shroud interface rubbing. The assembly has a stack of identical blades, obviating any need for relatively weak locking blades or pieces. The method defines the steps of forming a peripheral recess in a wheel, in which to secure root ends of blades, and setting the damping wires (or wire) therein prior to installing the blade root ends, and uniformly spacing-apart the blades after securing the same to the wheel.

28 Claims, 11 Drawing Figures

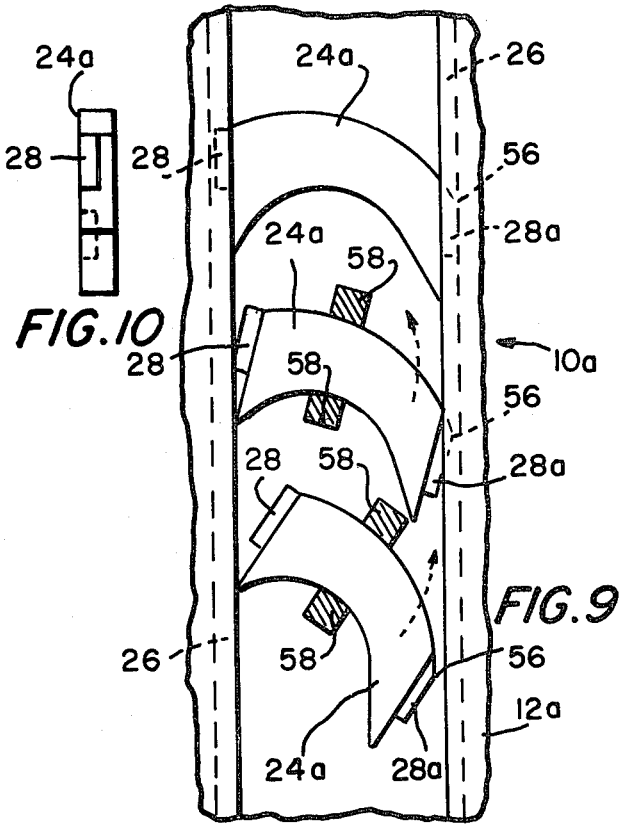
FIG. 10
FIG. 9
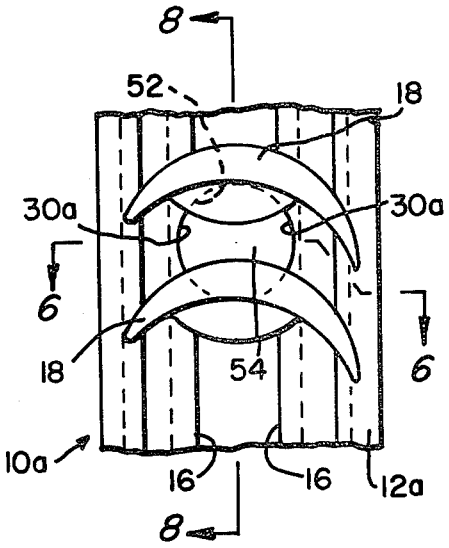
FIG. 7
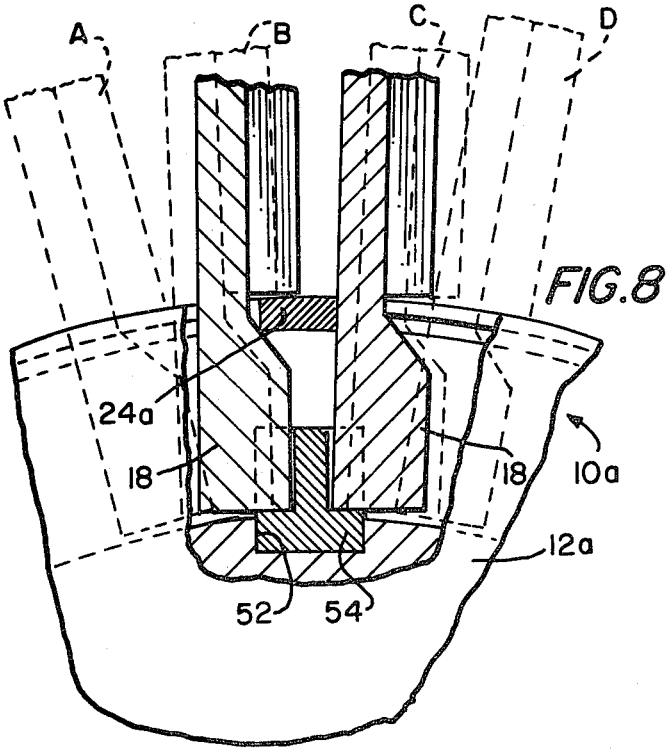
FIG. 8
FIG. 6
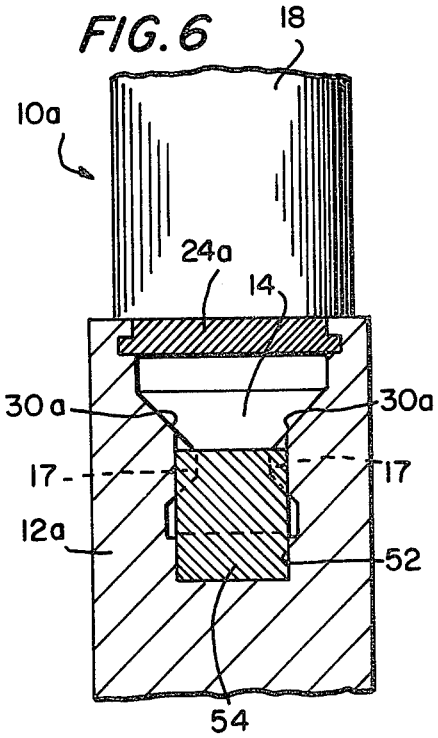

BLADED ROTOR ASSEMBLY AND METHOD OF FORMING SAME

This is a continuation-in-part of our co-pending application, Ser. No. 321,338, filed Nov. 16, 1981, which bears the same title.

Most blade failures, in bladed rotor assemblies, are attributed to vibratory-induced, alternating stress which fatigues the blade material. Blade vibratory stress is very sensitive to the amount of damping present. Damping usually takes the form of aerodynamic, material and friction damping. Of the three, friction damping is the only one which can be controlled, since material damping is an inherent property of the material, and aerodynamic damping is dependent on blade environment. It is an object of this invention to disclose a blade rotor assembly with novel friction damping. It is also an object of this invention to set forth a method of forming a bladed rotor assembly with such friction damping.

It is particularly an object of this invention to set forth a bladed rotor assembly, for a turbine or the like, comprising a wheel; said wheel having a periphery with a recess formed therein; said recess having confronting surfaces, a plurality of blades, each thereof having a root; said blades roots being set, radially, in said recess with at least a minute clearance between said roots and said surfaces; means interposed between at least one of said surfaces and at least a plurality of said roots for effecting damping (a) between said one surface and said plurality of roots, and (b) between said roots of said plurality thereof.

It is also an object of this invention to set forth a method of forming a bladed rotor assembly, for a turbine or the like, comprising the steps of: providing a wheel; forming a recess, having confronting surfaces, in the periphery of the wheel; setting at least one, substantially annular element loosely in said recess; providing a plurality of root-ended blades; securing the root ends of said blades in said recess with said element interpositioned between said root ends and at least one of said surfaces; and indexing said blades for a uniform spacing therebetween.

Further objects of this invention as well as the novel features thereof will become more apparent by reference to the following description taken in conjunction with the accompanying figures in which.

Figure 1:
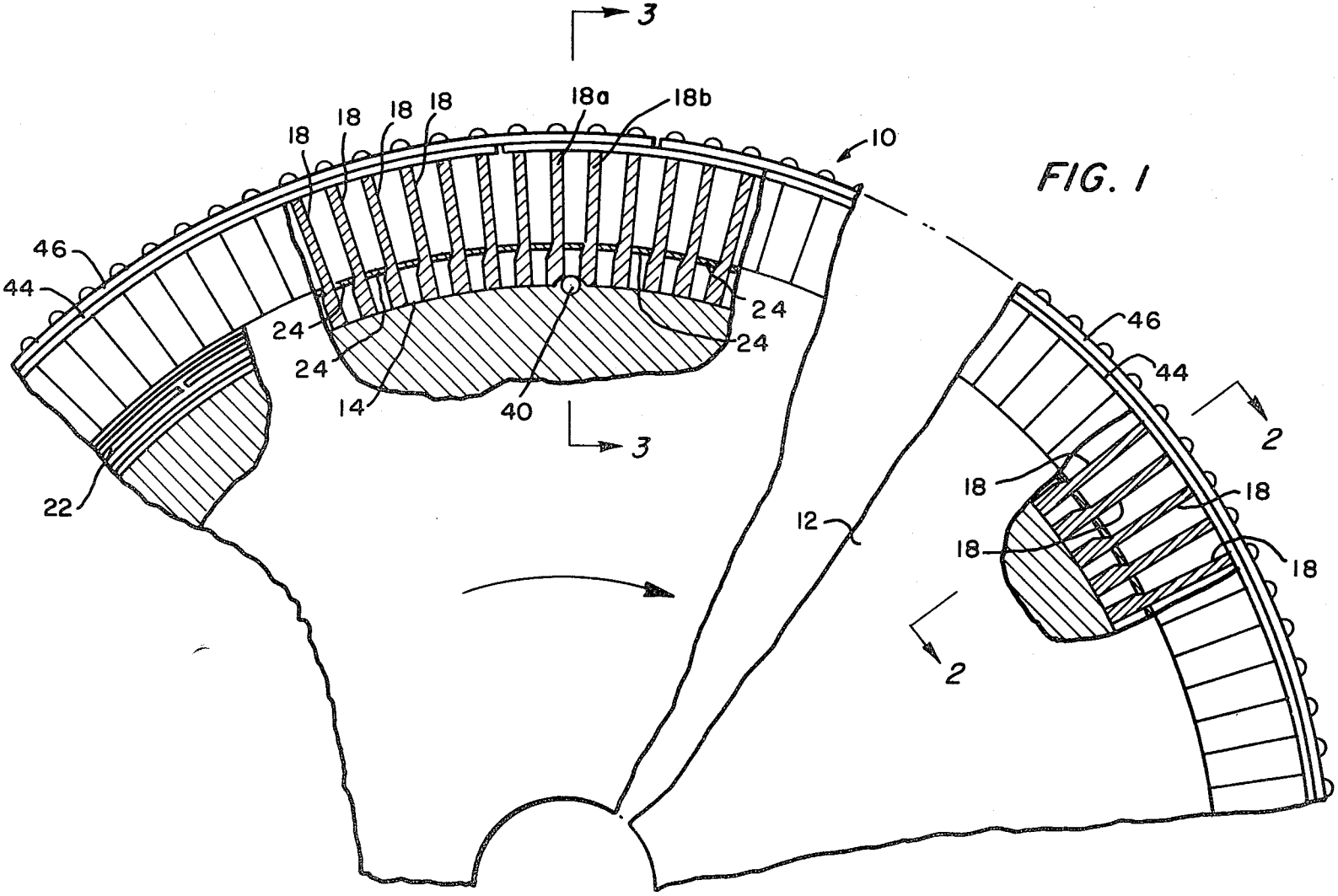
FIG. 1 is a fragmentary, elevational view, partly in cross-section, of an embodiment of the invention.

FIGS. 6–10 disclose the structure and features of an alternative embodiment of the invention, such embodiment comprising the subject of this continuation-in-part application.

FIG. 6 is a cross-sectional view, taken along section 6—6 of FIG. 7, showing a portion of the bladed rotor, a inner end portion of a blade, the locking plug, and a packer;

FIG. 7 is a plan view of a portion of the bladed rotor, less a blades-intervening packer; the latter is omitted in order that the locking plug might be viewed;

FIG. 8 is a cross-sectional view taken along section 8—8 of FIG. 7, showing as well, in phantom, progressive, displaced positionings of the blades in the recess in the wheel;

FIG. 9 is a plan view of a portion of the wheel showing, in progressive, sequential orientations, a packer being fixed in grooves in the wheel; and FIG. 10 is an end view of a packer.

As shown in FIGS. 1–5, a bladed rotor assembly 10, according to a first embodiment of the invention, comprises a wheel 12 in the periphery of which is formed a recess 14. The recess has, intermediate the depth thereof, inwardlyextending, keying prominences 16; the walls of the recess define confronting surfaces between which blades are fixed. It is a great plurality of root-ended blades 18 which are fixed in the recess, and the root end of each blade 18 has a tapered land 20 which engages the keying prominences to secure the blade in place. A plurality of circular damping wires 22 are loosely placed in the recess 14, between the shanks of the root ends and the confronting surfaces of the recess, prior to blades installation, in order to damp the blades vibration during operation of the rotor assembly 10. The wires 22 effect a frictional, rubbing contact between one or more of the blades 18, should such one or more vibrate out of phase or unison with the others thereof. Too, upon the blades vibrating in unison, the wires 18 more therewith and effect a damping frictional engagement with the confronting surfaces of the recess 14.

The blades 18 are set apart, throughout the periphery of the wheel 12, by means of intervening packers 24. Each packer is a plate-type element which has a concave and convex surface for defining an interfacing engagement thereof, on each side, with the airfoil-shaped bodies of the blades 18. Immediately adjacent the periphery of the wheel 12 are grooves 26, formed in each of the confronting surfaces, slidably to receive the guide limbs 28 of the packers 24.

The root ends of the blades 18 have a width "W" and a thickness "T" both of which are greater than the void obtaining between the prominences 16. Accordingly, to accommodate for the insertion of the root ends, at one point along the circumference of the recess 14, the keying prominences 16 are disrupted by arcuate cut-outs 30. To insert each blade 18 it is necessary only to turn it sideways about its elongate axis, that is, ninety degrees of arc from its normal attitude in the wheel 12, and pass its thickness ("T") dimension through the cut-outs 30. Then by turning it ninety degrees again, the land 20 will be locked in the lower portion in the recess 14 by the prominences 16. At a point near where the cut-outs 30 are formed, and on the outer periphery of the wheel 12, are a pair of reliefs 32 through which the guide limbs 28 of the packers 24 are passed into the grooves 26.

As can be appreciated, then, from the foregoing, blades 18 and packers 24 are assembled, in turn, onto the wheel 12. A first blade is set in place, via the cut-outs 30, and slid therefrom along the recess 14, and then a first packer 24 is set in place, via the reliefs 32, and slid therefrom along the grooves 26. In sequence, then, the rest of the complement of blades 18 and packers 24 are installed thusly, with two exceptions, however. The first and last blades installed are unique, to accommodate a final, pinned lock-up of the blade complement. The first to be installed is blade 18*a* (FIG. 4A); it has a chamfer 34, at the base of the root thereof, on the "suction" (i.e., convex) side of the blade body. The last blade to be installed is blade 18*b* (FIG. 4B); it has a chamfer 36, at the base of the root thereof, on the "pressure" (i.e., concave) side of the blade body.

Blade 18*a*, following insertion thereof, is slid fully circumferentially (substantially three hundred and sixty degrees of arc) along the recess 14 until it is adjacent to the cut-outs 30, again, by means of which it accessed the recess 14. The full, remaining complement of blades (and packers) is set in the recess 14, in like manner, to line up, juxtapositionally, behind blade 18*a*. The last blade 18*b*, then, is installed, and it too will be immediately adjacent to the cut-outs 30, albeit opposite them from blade 18*a*. The final packer 24 is then set into the space intervening blades 18*a* and 18*b*, via the reliefs 32. Now, all blades and packers are shifted until blades 18*a* and 18*b* are astride the cut-outs 30.

In traverse of the wheel 12, and opening onto the cut-outs 30, is formed a locking-pin hole 38. A pin 40 is press-fitted into the hole 38 to interface the chamfers 34 and 36. During installation of pin 40, it may be necessary to make minor, adjusting re-orientations of the blade complement, in order to admit the pin between the chamfers.

With the pin 40 in place the packer 24 most adjacent to the reliefs 32 is sufficiently displaced from the latter to prevent its access thereto, and the pin 40 blocks access to the cut-outs 30 by blades 18*a* and 18*b*.

Figure 2:
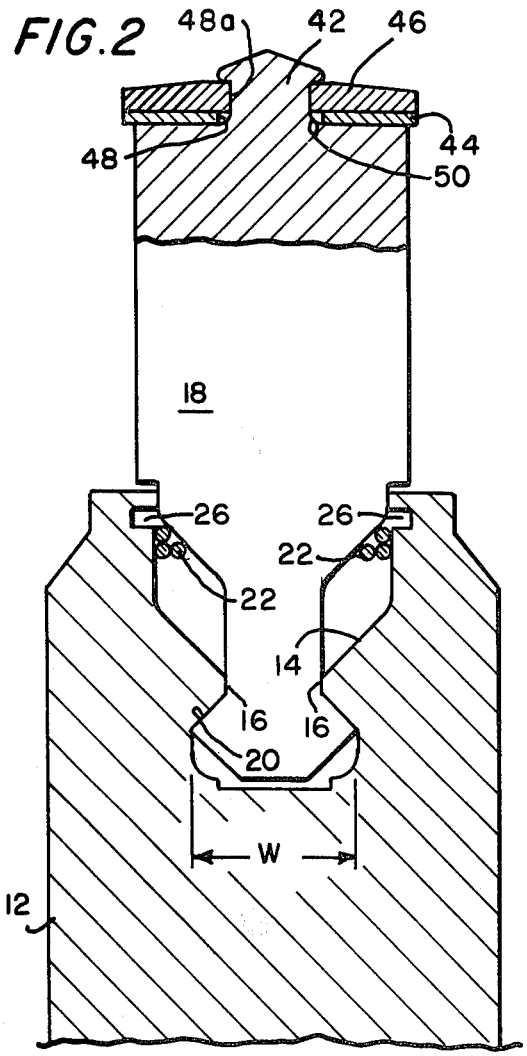
FIG. 2 is a cross-sectional view taken along section 2—2 of FIG. 1.
Figure 4A:
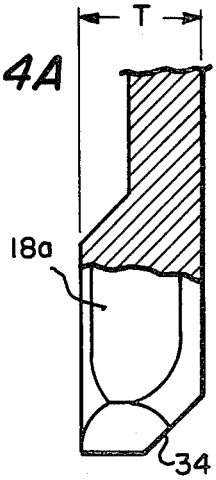
FIG. 4A is a fragmentary view, partly in cross-section, of the root end of one of two locking-pin confronting blade roots.
Figure 4B:
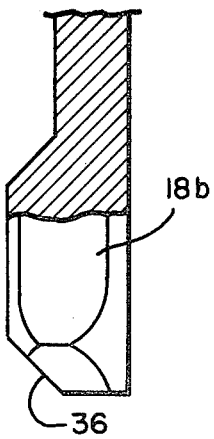
FIG. 4B is a view, like that of FIG. 4A, of the root end of the other of the two locking-pin confronting blade roots.
Figure 3:
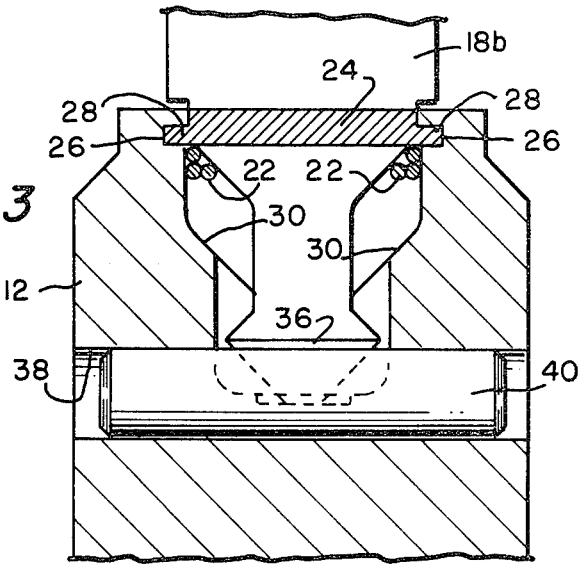
FIG. 3 is a cross-sectional view taken along section 3—3 of FIG. 1.

As explained thus far, then, the damping wires 22 are set loosely in the recess 14 of the wheel 12. Thereafter, the blades 18, 18*a* and 18*b* and packers 24 are installed in the wheel 12, with the wires 22 interposed between the confronting side surfaces of the recess 14 and the blade roots. As shown in FIGS. 2 and 3, a plurality of wires 22 are employed in this exemplary embodiment. However, in alternative embodiments, single wires 22, on each side of the blade roots may be employed. Too, single "damping" wires 22 of one given gauge may be used, as aforesaid, with one or more "loading" wires 22 of same or different gauge set in thereunder to load the single "damping" wires.

The wires 22, of whatever complement, are rolled to define thereof substantially the diameter of the wheel 12; i.e., a three hundred and sixty degree loop, of approximately or substantially the aforesaid diameter, and cut to that dimension. Then they are set into the recess 14. Next, they are cut, once more, to define a small gap between the ends thereof. Where three wires 22 are used, as shown in this embodiment, in the opposite sides of the recess, they are set with the end-gaps spaced apart. Thus, the wires are set with the gaps approximately one hundred and twenty degrees apart.

The blades 18, 18*a* and 18*b* are loosely set in the recess 14. Following their insertion, and setting apart by means of the packers 24, they can be slightly rocked from side to side, and fore and aft, pivotably on the keying prominences 16; they can also be displaced, axially, if ever so slightly. Simply, they and the recess 14 define a minute clearance therebetween. This design, together with the novel cut-outs 30 and packers 24, accommodates a simple, quick and inexpensive assembly of the bladed rotor without sacrificing efficiency thereof. Notwithstanding the relatively loose fit of the blades 18, 18*a* and 18*b* and packers 24 in the wheel 12, they cooperate to substantially close off the recess 14, from the working bodies of the blades. This can be seen in FIGS. 1, 3 and 5. The packers 24 close into near engagement with the pressure and suction sides of the blades, define a land between the blades—bridging across the recess 14—and define a common surface with peripherally outermost surfaces of the wheel 12. There obtains a very small clearance between each blade and packer in the full complement of blades 18, 18*a* and 18*b* and the packers 24. This is so that an optimum tolerance build-up will be provided to facilitate assembly of the aforesaid full complement in the wheel 12, otherwise the last blade 18*b* or the last packer would not be able to be properly fit in the wheel 12, unless the same were undersized or oversized.

The packers 24 intervene between the blades, and set the latter apart, but other means are employed uniformly to space apart the blades of the complement thereof. Such spacing means are shrouds.

The outermost ends of the blades 18, 18*a* and 18*b* have tenons 42 extending therefrom which are received in inner and outer shrouds 44 and 46. The inner shroud 44 has a plurality of precisely-spaced apertures 48 which are larger than the cross-sectional dimension of the tenons 42, and the outer shroud 46 has precisely-spaced apertures 48*a* which are of substantially the same dimension as the tenon cross-sections, albeit slightly larger to aid assembly. The shrouds 44 and 46 are disposed in surmounting relationship, and the tenons 42 are passed through the inner shroud, through the outer shroud 46, defining a close fit with said apertures 48*a*, and are fixed thereto by peening over the ends (of the tenons 42) and creating an interference fit between the tenons and said apertures 48*a*.

The larger apertures 48, in the inner shroud 44, accommodate therewithin a slightly radiused, stress-relieving conformation at the base 50 of the tenons 42. The inner shroud 44 is of approximately half the thickness of the outer shroud 46. This defines a difference in masses therebetween which, in cooperation with the relative spacing between the shanks of the tenons 42 and the surfaces of the apertures 48, gives rise to a relative sliding or damping movement between the shrouds.

In this, our disclosure, we cite the inner shroud 44 and the outer shroud 46. In fact, in this embodiment, there are a plurality of inner shrouds and outer shrouds. By way of example, twenty inner and outer shrouds 44 and 46 are used, each thereof subtending an arc of substantially eighteen degrees. Each of the shrouds has seven apertures 48 and 48*a*, respectively, formed therein, equally spaced apart. A set of seven blades 18, then, with the therewith engaged shrouds, defines a packetted assembly, and twenty of such assemblies define the full complement for the bladed rotor assembly—in this embodiment.

The shrouds 44 and 46 are in surmounting relationship, as stated, but the ends of each are displaced, or circumferentially spaced apart. As shown in FIG. 1, for example, the shroud ends are a minimum of four blade positions apart. Thus, for any given shroud the gaps thereof are bridged across by another inner or an outer shroud. Also, the ends of the shrouds most adjacent to the locking pin 40 are not less than two blade positions away from the pin.

By restricting blade end motion through continuous shrouding, vibratory modes with end or tip motion are eliminated, as well as we all but one of the out-of-phase modes. This significantly reduces the number of vibratory modes associated with packetted assemblies. This suppresses the first tangential cantilevered vibratory mode which is the most severe since it is the most easily excited. The overlapping shroud design offers additional damping from friction rubbing along the shroud interfaces and also allows the bladed rotor to be easily assembled.

Friction damping, provided by the wires 22, is the result of the interface rubbing along the wires surfaces. The amount of damping present is dependent upon centrifugally induced wire loading reacting against the blades and the surfaces of the recess and its associated coefficient of friction. By varying the mass of the wire or wires 22, the load is easily controlled for a given set of parameters.

The damper wire or wires 22, set between the blades 18 and the walls of the recess 14 dissipate vibratory energy independent of relative blade motion. The invention, therefore, operates under two likely conditions created by excitation frequency: (1) When the motion of the blades 18 is in unison, the damper wires 22 will follow the blades, creating slippage along the interface of the wires and the wall of the recess 14; (2) When a difference in relative blade motion occurs, i.e., with the blades "out-of-phase" with each other, the slippage occurs along the blades and the damper wires interfaces.

The damper wires 22 are capable of deflecting enough to take up a tolerance difference between the blades 18 while still producing the required blade loading. This requirement is met by providing damper wires 22 small enough to deflect into a loading position and, if necessary, by stacking additional wires 22 behind, to create the optimum loading.

Key benefits of this invention are: (1) elimination of several vibratory modes, including the easily excited first tangential cantilevered vibratory mode; (2) damping control optimization of vibration of blades 18 excited in-phase or out-of-phase, relative to one another; (3) blade spacing of blades 18 controlled by shroud tenon apertures 48 and 48*a*; (4) submerged damper wires 22 do not interfere with blade airfoil performance or the structural integrity of the blades 18; (5) damper wires 22 damp tangential, axial and torsional vibratory modes; (6) damper wires 22 seat themselves properly with blade tolerances; (7) wires 22 and recess 14 are covered by the packers 24, providing a smooth steam path at airfoil base of the blades 18; (8) shrouding of the blades seals the steam path at the outer diameter of the wheel 12, hence greater blade performance results; (9) as the shrouds are overlapped, they are not subject to hoop stress; (10) the inner blade shroud 44 is designed to ride on the outer shroud 46 adding damping from shroud rubbing; (11) the arcuate cut-outs 30 allow for a full complement of blades 18 of equal strength (no weak locking blades); (12) low cost, easily assembled, loose fitting blades 18; and (13) separate blade packers 24 minimize blade mass for higher speed capability.

In the alternative embodiment 10*a*, shown in FIGS. 6–10, a much simpler structure is defined. Embodiment 10*a* dispenses with a need for chamfered blades 18*a* and 18*b*. Rather, all the blades 18 are of identical configuration. Too, the locking pin 40 and the pin hole 38 therefor are not needed. Finally, reliefs 32 are unnecessary, and the cutouts 30*a* are defined by a single-radius drill hole.

Embodiment 10*a* includes the damping wires (or damping wire) 22 as well as the tenons 42 and shrouds 44 and 46, as in the embodiment 10 of FIGS. 1–5. However, a greatly simplified blade insertion and locking arrangement is comprised thereby. The wheel 12*a* has the recess 14 formed therein which defines a trough in which to receive the root-ends of the blades 18. The latter trough or recess 14 has the keying prominences 16 formed therein, the latter projecting towards each other across the recess. Again, the blades 18, in the root-ends thereof, have key-way-type surfaces 17 which slidably engage the prominences 16. The blades 18 have the same aforesaid lands 20 which engage the undersides of the prominences 16, whereby the blades are held in the recess 14.

As described in connection with embodiment 10, the blades 18 are inserted into the recess 14 by passing the root-ends thereof through an access, with the blades turned ninety degrees of arc from their normal, operative disposition in the wheel 12*a*. The root-ends are passed between the prominences 16, and then turned again, ninety degrees, to bring the lands 20 into engagement with the prominences 16. In this embodiment 10*a*, the access for the root-ends is defined by a single-radius drill hole 52. Drill hole 52 is formed into a given depth below the bottom of the recess 14 and, as will be appreciated, defines the cut-outs 30*a* during the formation thereof. Cut-outs 30*a*, then, serve the same root-ends access for the blades (as do cut-outs 30, in embodiment 10)

Where embodiment 10 employed a pin 40 to prevent inadvertent travel of blades 18*a* or 18*b* into the access cut-outs 30, this embodiment 10*a* employs a locking plug 54. Plug 54 has a circular base which is nestably received in the drill hole 52 and an upstanding shank with accurate reliefs on opposite sides thereof. One of the reliefs is shaped to complement, and define an interface with, the convex surface of one of the blades 18. The other relief is shaped to complement, and define an interface with, the convex surface of the root-end of another of the blades 18. These latter two blades, as will be understood, correspond to blades 18*a* and 18*b* of the embodiment 10; either one of these two shall have been the first one set into the recess 14, upon the blading of the wheel 12*a* being undertaken, and the other shall have been the last one set into the wheel 12*a*.

Figure 5:
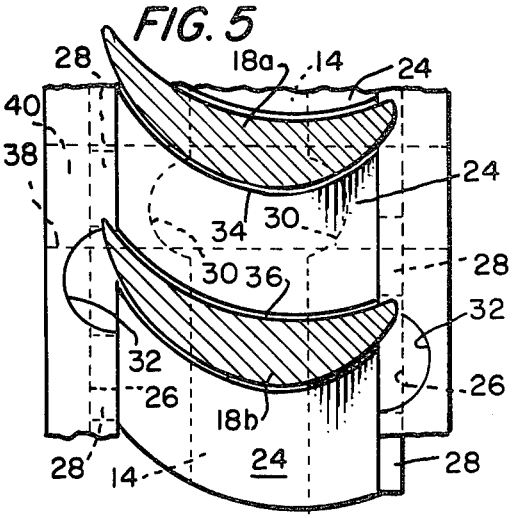
FIG. 5 is a fragmentary plan view of the periphery of the novel bladed rotor assembly, less the shrouds, and with only two cross-sectioned blades shown in place.

On blading the wheel 12*a*, a first-inserted blade 18 may assume a position "A" as shown in dashed outline in FIG. 8, and a last-inserted blade 18 may assume a dashed outline position "D". Then, the plug 54 is inserted into the hole 52 to prevent either of these two blades from returning to radial alignment with the cut-outs 30*a*. The shank of the plug 54, of course, is oriented to enable the aforesaid interfaces with the mating surfaces of these two blades 18. Next, as was disclosed for embodiment 10, a packer is set between these blades. The packers 24*a* in this embodiment 10*a* are slightly different from those (24) in the embodiment 10. Packers 24*a* have a corner of one of the guide limbs thereof rounded off. Guide limb 28 at one side of each packer 24*a* is substantially rectangular, but guide limb 28*a* at the other side has the aforesaid rounded-off corner 56. By this provisioning, the packers 24*a* can be set in place without need for the reliefs 32 (FIG. 5, embodiment 10). FIG. 10 illustrates how each packer 24*a* is engaged with the guide limb grooves 26. Each packer 24*a* is first oriented as shown in the lower-most position in FIG. 10, and lowered to the recess 14. The guide limb 28*a* is aligned with the right-hand groove 26 (as viewed in FIG. 10) and turned counter-clockwise.

The turning is continued until the guide limb 28 accesses the left-hand groove 26 and passes thereunto, and the packer 24*a* comes to its limit-stop positioning—shown at the top of FIG. 10. This may be done with the thumb and forefinger, or needle-nose pliers, gripping jaws 58 of which are shown in cross-section, may be used.

With the plug 54 in place, between the first-and-last-inserted blades 18, and the last, intervening packer 24*a* fixed in the grooves 26, it remains only to secure the plug 54 and do the shrouding. As noted, the aforesaid first and last blades 18 may be in phantomed positions "A" and "D", with perhaps fifty, seventy-five, or one hundred millimeters spacing therebetween. Now then, they and all other blades 18 (of the full complement thereof) must be justified i.e., they need to be positioned with substantially equal spacing therebetween. This is necessary in order that the tenons 42 will properly align with the apertures 48 and 48*a* in the shrouds 44 and 46. The latter apertures, of course, are so predetermined that the blades 18 will be properly and equally spaced therebetween. In justifying or positioning the blades 18, then, the first-and last-installed blades 18 will move from phantomed positions "A" and "D" through positions "B" and "C", to the full-line positionings thereof shown in FIG. 8. In the latter, final positionings, the bottoms of the root-ends of these two blades 18 come to set above the base of the plug 54. The blades 18 interface the shank of the plug 54 but, as just noted, the bottoms thereof intrude between the plug base and the periphery of the wheel 12*a*. Hence, the plug 54, set in the hole 52, prohibits access of the blades 18 to the cut-outs 30*a*, and the blades prevent an inadvertent removal of the plug 54 from the hole 52.

While we have described our invention in connection with specific embodiments thereof, it is to be clearly understood that this is done only by way of example, and not as a limitation to the scope of our invention as set forth in the objects thereof and in the appended claims.

We claim:

1. A bladed rotor assembly, for a turbine or the like, comprising:

a wheel;

said wheel having a periphery with a recess formed therein;

a plurality of blades, each thereof having an end which defines a root;

said recess defining a trough having confronting surfaces;

said blades, of said plurality thereof, each having surfaces on opposite sides thereof interposed between, and engaged with, said confronting surfaces;

at least one pair of said engaged confronting and side surfaces has means cooperative for retaining said blades in said trough;

said trough having means defining an access, for accommodating selective insertion and removal of said blade ends therethrough, for entry of said blade ends into, and withdrawal of said blade ends from, said trough; and locking means, wholly confined within said trough, and in obstruction of said access, for preventing movement of said blade ends through said access; wherein at least one of said blades has at least a portion thereof interposed between said locking means and said periphery to prevent removal of said locking means from said trough; and further including packer means, engaged with said periphery and interposed between said blades of said plurality thereof, for uniformly setting apart said blades; wherein said packer means comprises a plurality of bladespacing packers; and all blades of said plurality thereof are identical and all packers of said plurality thereof are identical.

2. A bladed rotor assembly, according to claim 1, wherein:

a plurality of said blades have at least portions thereof interposed between said locking means and said periphery to prevent removal of said locking means from said trough.

3. A bladed rotor assembly, according to claim 1, wherein:

said blades-retaining cooperative means comprises first means defining a prominent key formed on one of said surfaces of said pair, and second means defining a recessed keyway formed in the other surface of said pair.

4. A bladed rotor assembly, according to claim 1, wherein:

said access is defined by at least one cut-out formed in at least one surface of said pair of engaged confronting and side surfaces.

5. A bladed rotor assembly, according to claim 3, wherein:

said access is defined by at least one cut-out formed in said key.

6. A bladed rotor assembly, according to claim 1, wherein:

said access comprises a plurality of cut-outs formed in said confronting surfaces.

7. A bladed rotor assembly, according to claim 1, wherein:

said access comprises a radial borehole formed in said wheel;

said confronting surfaces are spaced apart a given dimension;

said borehole has a diameter which is greater than said given dimension; and said borehole defines a pair of confronting, arcuate cut-outs in said confronting surfaces.

8. A bladed rotor assembly, according to claim 7, wherein:

said trough has a given depth; and said borehole penetrates into said wheel further than said given depth, to define a circular recess therein.

9. A bladed rotor assembly, according to claim 8, wherein:

said locking means comprises an element having a circular base and an upstanding shank; and said base is nested in said circular recess.

10. A bladed rotor assembly, according to claim 9, wherein:

said shank has concave surfaces on opposite sides thereof.

11. A bladed rotor assembly, according to claim 9, wherein:

said shank is interposed between, and defines an interface with, roots of a pair of said blades.

12. A bladed rotor assembly, according to claim 1, wherein:

said blade roots are set, radially, in said trough with at least a minute clearance between said roots and said confronting surfaces; and means interposed between at least one of said confronting surfaces and at least a plurality of said roots for effecting damping (a) between said one confronting surfaces and said plurality of roots, and (b) between said roots of said plurality thereof.

13. A bladed rotor assembly, according to claim 12, wherein:

said damping means comprises a substantially annular element.

14. A bladed rotor assembly, according to claim 12, wherein:

said damping means comprises a plurality of substantially annular elements.

15. A bladed rotor assembly, according to claim 12, wherein:

said damping means comprises means for effecting a frictional, rubbing contact thereof (a) between said one confronting surface and said plurality of roots, and (b) between said roots of said plurality thereof.

16. A bladed rotor assembly, according to claim 1, wherein:

said blades have cross-sections which define a common airfoil shape with surfaces having given concave and convex configurations; and said packers have blade-confronting edges on opposite sides thereof, formed with the same said given configurations.

17. A bladed rotor assembly, according to claim 16, wherein:

said wheel and said packers have means which cooperatively define a slidable engagement of said packers with said wheel.

18. A bladed rotor assembly, according to claim 16, wherein:

said periphery has a pair of parallel, circumferential lands which define said recess therebetween; and said packers each engage and bridge across said lands, and substantially close off said recess, at said periphery, between said blades.

19. A bladed rotor assembly, according to claim 1, further including:

means engaged with the ends of said blades which are opposite said root ends thereof properly spacing each of said blades from the others of said plurality thereof.

20. A bladed rotor assembly, according to claim 19, wherein:

said spacing means comprises means banding said opposite blade ends together in uniformly spaced-apart disposition.

21. A bladed rotor assembly, according to claim 20, wherein:

said opposite ends of said blades have tenons thereat;

said banding means comprises a shroud;

said shroud having a plurality of precisely spaced-apart apertures formed therein; and said tenons are engaged with said apertures.

22. A bladed rotor assembly, according to claim 21, wherein:

said banding means comprises a pair of shrouds;

each of said shrouds having said precisely spaced-apart apertures formed therein;

one of said shrouds of said pair surmounts the other thereof, with apertures of said pair in throughgoing alignment; and said tenons penetrate apertures of said other shroud, and are secured in apertures of said one shroud.

23. A bladed rotor assembly, according to claim 22, wherein:

said apertures in said other shroud are larger than said apertures in said one shroud.

24. A bladed rotor assembly, according to claim 22, wherein:

said tenons and said apertures in said one shroud have mutually complementary configurations and dimensions to define an interference fit therebetween.

25. A bladed rotor assembly, according to claim 21, wherein:

said blades each have a body poriton whereat said airfoil-shape cross-section is defined;

said blade roots extend from said body portions at one end of thereof, and said tenons extend from said body portions at the opposite ends thereof; and said tenons are radiused, at the innermost ends thereof, where they commence to extend from said body portions.

26. A bladed rotor assembly, according to claim 22, wherein:

one shroud of said pair extends in a given circumferential direction farther than does the other shroud of said pair, and said other shroud of said pair extends in the opposite circumferential direction farther than does said one shroud of said pair.

27. A bladed rotor assembly, for a turbine or the like, comprising:

a wheel;

said wheel having a periphery with a recess formed therein;

a plurality of blades, each thereof having an end which defines a root;

said recess defining a trough having confronting surfaces;

said blades, of said plurality thereof, each having surfaces on opposite sides thereof interposed between, and engaged with, said confronting surfaces;

at least one pair of said engaged confronting and side surfaces has means cooperative for retaining said blades in said trough;

said trough having means defining an access, for accommodating selective insertion and removal of said blade ends therethrough, for entry of said blade ends into, and withdrawal of said blade ends from, said trough; and locking means, wholly confined within said trough, and in obstruction of said access, for preventing movement of said blade ends through said access; wherein at least one of said blades has at least a portion thereof interposed between said locking means and said periphery to prevent removal of said locking means from said trough; and further including spacing means engaged with said periphery for uniformly setting apart said blades; wherein said spacing means comprises a plurality of platetype, blade-spacing elements; and all blades of said plurality thereof are identical, and all blade-spacing elements of said plurality thereof are identical.

28. A bladed rotor assembly, according to claim 27, wherein:

said elements are interposed between, and are separate from, said blades of said plurality thereof.

* * * * *